US005092316A

United States Patent [19]

Taylor et al.

[11] Patent Number: 5,092,316

[45] Date of Patent: Mar. 3, 1992

[54] PHYSIOTHERAPY DEVICE

[76] Inventors: Alan R. G. Taylor, The Coppice, Chapel Hill, Bolingey, Cornwall TR6 0D0; Matthew J. C. Stobart, Bernel, New Road, Stithians, Truro, Cornwall TR3 7BL, England

[21] Appl. No.: 424,279

[22] PCT Filed: Apr. 27, 1988

[86] PCT No.: PCT/GB88/00324

§ 371 Date: Oct. 23, 1989

§ 102(e) Date: Oct. 23, 1989

[87] PCT Pub. No.: WO88/08290

PCT Pub. Date: Nov. 3, 1988

[30] Foreign Application Priority Data

Apr. 27, 1987 [GB] United Kingdom ..... 8709940

[51] Int. Cl.[5] ..... A61H 7/00

[52] U.S. Cl. ..... 128/51; 128/33; 128/53

[58] Field of Search ..... 128/33, 38, 39, 40, 128/44, 51, 52, 53, 24 R, 24.2

[56] References Cited

U.S. PATENT DOCUMENTS

| | | | |
|---|---|---|---|
| 2,193,882 | 3/1940 | Peterson . | |
| 2,664,882 | 1/1954 | Parker | 128/33 |
| 2,672,860 | 3/1954 | Badger et al. | 128/33 |
| 2,773,498 | 12/1956 | Himmelman | 128/33 |
| 3,656,190 | 4/1972 | Regan et al. | 128/33 X |
| 4,576,149 | 3/1986 | Otuka et al. | 128/44 X |

FOREIGN PATENT DOCUMENTS

| | | |
|---|---|---|
| 650683 | 9/1937 | Fed. Rep. of Germany . |
| 1129437 | 1/1957 | France . |
| 1359485 | 7/1974 | United Kingdom . |

*Primary Examiner*—Robert Bahr

*Attorney, Agent, or Firm*—Ware, Fressola, van der Sluys & Adolphson

[57] ABSTRACT

A physiotherapy device for treating spinal disorders comprises a body (6) housing actuating rams operating on pistons (14) which carry feet (15). The pistons (14) are caused to reciprocate so that while one diagonal pair is raised, the other will be lowered and vice versa. The device is applied so that the feet (15) rest on the lateral ends of transverse processes to either side of a pair of adjacent vertebrae. The reciprocating motion of the feet (15) then causes a counter-rotational movement between the pair of vertebrae being treated. This can be used to help to relieve a loss of mobility between the joints of the spine. In an alternative use blows are delivered rapidly by the feet (15) so as to trigger natural stretch reflexes which will cause the vertebrae to be brought back into normal alignment from an abnormal displaced condition.

8 Claims, 3 Drawing Sheets

PHYSIOTHERAPY DEVICE

BACKGROUND OF THE INVENTION

The invention relates to apparatus and procedures designed to correct mechanical disorders of the spine.

The backbone is a complex structure and misuse of the body can result in spinal disorders producing various types of back or neck pain. The precise mechanical disorder is often difficult to diagnose, and even if the source of a malfunction can be determined, the correction of the disorder is far from easy as interactions between vertebrae are incredibly complex, and thus correction of a fault in one area can lead to transference of the problem, possibly in a modified form to another area. Attempted correction of the transferred problem can then lead to the reappearance of the original problem. A further type of disorder results from loss of mobility of the joints of the dorsal spine. Consequently remedial manipulation applied to a vertebra will result in movement of adjacent ones and it is difficult to increase the intravertebral mobility other than over a substantial period of treatments, using conventional manipulative techniques. The invention aims to provide both apparatus and manipulative procedures using that apparatus which enable a physiotherapist to achieve substantial improvements to the conditions referred to above in a relatively short time in the majority of cases.

SUMMARY OF THE INVENTION

Accordingly, from a first aspect, this invention provides a physiotherapy device comprising a body housing a pair of reciprocatory actuators terminating in feet and projecting in the same direction but displaced at a distance equivalent to the spacing of the lateral ends of transverse processes to either side of a human vertebra, and means for reciprocating the actuators in mutually opposed directions.

The reciprocating actuators cause rotational displacement of a vertebra with respect to the adjacent one. In order to avoid significant movement of adjacent vertebrae, in one embodiment, the body will include fixed feet positioned to rest on transverse processes of adjacent vertebrae. In the preferred arrangement, however, four reciprocatory actuators are housed within the body and terminate in feet which will rest on the two pairs of transverse processes on an adjacent pair of vertebrae, each diagonal pair of actuators acting synchronously but in mutually opposed directions to the other pair of actuators. These enable an adjacent pair of vertabrae to be rotated in mutually opposite directions. Rocking these two vertebrae in counter-rotation means that less movement has to be applied to each vertebra which will therefore limit the likelihood of neural concussion of the spinal nerves during treatment.

Ideally, the actuators will be controlled by at least one reciprocatory operating member. In one arrangement the device can be constructed so that one operating member controls operation of a linkage to act against a bias member which biases one foot into an extended condition, so as to cause the other foot to be extended. Alternatively, the device may be such that each actuator is or incorporates an operating member, the set of operating members being mutually operated by a control circuit.

In one preferred arrangement the reciprocatory operating members will comprise pneumatic or hydraulic rams operated by a fluid logic control circuit, or solenoids operated by an electrical control circuit. Where a control circuit is present it is desirable that it should include adjustment means to enable the speed and force of operation of the actuators to be varied.

From a further aspect, the invention provides a method of relieving mechanical disorders of the spine using a device of this invention as hereinbefore defined, wherein the feet of the device are located over the lateral ends of the transverse processes of affected vertebrae and the device is operated to cause reciprocation of the actuators to deliver blows to the vertebrae to stimulate rotational displacement about the spinal axis of at least one vertebra with respect to the adjacent vertebrae and moving the device along the spine to cause similar displacement to a sequence of vertebrae.

BRIEF DESCRIPTION OF THE DRAWINGS

The invention may be performed in various ways and preferred embodiments thereof will now be described with reference to the accompanying drawings, in which.

DETAILED DESCRIPTION OF THE PREFERRED EMBODIMENTS

If a vertebral joint is abnormally stressed (so that it is displaced, under normal conditions, out of its correct relationship with adjacent vertebrae) root compression of the spinal nerve may readily result.

Figure 1:
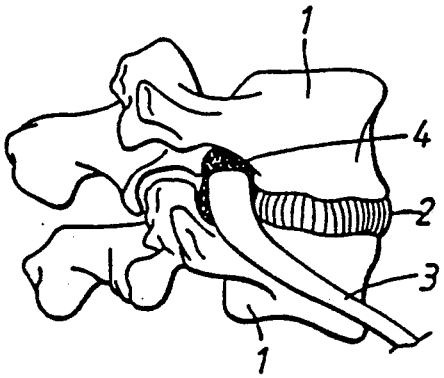
FIG. 1 is an illustration of a pair of human vertebrae in side view.

FIG. 1 shows two vertebrae 1 with an intermediate intervertebral disc 2. A spinal nerve 3 projects through spaces defined by semi-circular notches in adjacent vertebrae. Misalignment of one of the vertebrae 1 can then cause compression of the spinal nerve in the area 4. Momentary closure will be sufficient to cause irritation in the spinal nerve and sensitive dura. When the spine is abnormally stressed, root compression will commonly occur during light tasks well within the range of normal activity. The patient tends to adopt a distorted posture in order to alleviate this root compression, and this tends to reinforce or exacerbate the existing malformation of the spinal column.

A joint is an inert as distinct from a contractile structure. Therefore, the disposition of a joint must be an expression of the forces acting on it. In other words, if a normal joint adopts an abnormal position then it must be abnormally stressed. Similarly, if a structurally normal spine adopts abnormal curvatures, then it must be abnormally stressed. The segments of the spine are designed to move in a co-ordinated fashion. Abnormal stressing and abnormal performance imply loss of proper co-ordination. In man, co-ordination of movement is achieved by a mass of interacting reflex responses which are automatic and do not require detailed instruction from the brain. The principal component is the stretch reflex. The stretch reflex involves a relatively simple nervous circuit which causes a muscle to contract automatically in response to being stretched When we perform tasks such as lifting and twisting, the resulting forces try to displace the vertebrae of the spine. In the normal course of events, these forces are resisted automatically by muscle contraction. The greater the pull, the stronger the contraction. In this way, we remain co-ordinated automatically and can perform a great variety of tasks without a mass of detailed instruction.

There is a natural limit to the power and speed of these contractions. We may exceed the power when lifting a heavy object awkwardly or we may exceed both power and speed during some violent incident such as a heavy fall. In these circumstances, vertebrae will be displaced in relation to their neighbors. When this occurs, the system will automatically readjust and the disorganization will persist Reflex responses will continue to respond to stimuli as before. Co-ordinated movement will continue as before, but the details of co-ordination will be altered. The system will naturally resist disorganization, but once disorganization has occurred the system will compensate to the new state. The stretch reflexes can be stimulated to cause rapid, kick-like movements of individual vertebrae. It is believed that if a great number of these reflex responses are triggered in sequence (which can be random), the system will progressively readjust its state of balance in the direction of least effort. Once the point of least effort has been reached, the continued stimulation of reflexes will effect no further change of geometry. If the system is left free of external influence while the reflexes are being stimulated, the point of least effort will be the desired state of balance with the spine smooth and straight.

It is the primary function of the device of the invention to trigger a great number of these reflex responses in sequence, whilst exercising no further influence on the system.

A further objective is to use the device to alleviate a common complicating disorder involving loss of mobility in the joints of the dorsal spine. If the dorsal spine is immobile, then any movement which should involve the dorsal spine, will cause abnormal stressing and abnormal performance of the lumbar and cervical spines. Not surprisingly, violent or forceful mobilization is of little benefit and continues the cycle of soft tissue damage, inflamation, and exacerbation. Exercise is of limited value and may aggravate the back pain.

All the best mobilization techniques are passive, gentle and progressive. These techniques involve physiotherapists using their hands. It may take many hours to produce a marginal almost imperceptible improvement. Use of the device of the invention can create rapid and effective mobilization automatically. It is an essential feature of the device that its action provides passive mobilization which is gentle and progressive.

The current design of manipulation tool is a pneumatic hand-held device. The patient lies face down while the device is run up and down the length of the spine. It operates pads which cause the vertebrae to be rocked back and forth in a see-saw motion. The rocking motion is produced by applying pressure alternately to the lateral ends of the transverse processes 5 (see FIG. 2). The current design employs four pads operated by four double acting actuators controlled by logic gates which, in turn, are sensitive to supply and exhaust pressures.

Figure 2:
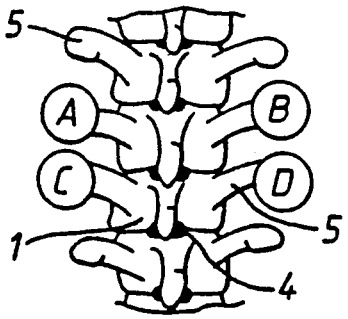
FIG. 2 is a plan view of a sequence of vertebrae.

The actuators are synchronized so as to cause adjacent pairs of vertebrae to be rocked in opposite directions. FIG. 2 illustrates an adjacent pair of vertebrae. A, B, C and D represent the four pads. Pads A and D apply pressure simultaneously causing the two vertebrae to be rocked in opposite directions. The cycle is then reversed; pads A and D are withdrawn automatically and pads B and C apply pressure. Thus, the two vertebrae are rocked back and forth in counter rotation.

As the device is passed up and down the spine every vertebra is exercised in relation to its neighbors. The size and shape of vertebrae will vary throughout the length of the spine and from patient to patient. The spacing of the pads and the size of the pads has been carefully chosen to cover the greatest variation possible. This problem is eased by the cushion of soft tissue that lies between the pads and the transverse processes.

It is an essential feature of the invention that it does not force a vertabra to move by any predetermined amount. It would be very dangerous to attempt to do this. The device applies a predetermined pressure to the transverse process. The condition of the joints will determine how much a vertebra moves in response to the pressure. Alternating pressures gently tease movement in the joint. At first, the movement may be imperceptible. As the joints are exercised and become more supple, so the amplitude increases automatically.

The amount of pressure applied to the transverse processes is predetermined by controlling the supply pressure to the actuators of the device. The speed of operation is controlled by regulating the exhaust pressure. When stress relieving, the device is adjusted so as to deliver a very light but very fast blow. The blow is sufficiently fast to trigger the stretch reflex. As soon as the blow has been struck, the pad is rapidly withdrawn leaving the vertebral system to follow the path of least resistance free of external influence.

Figure 6:
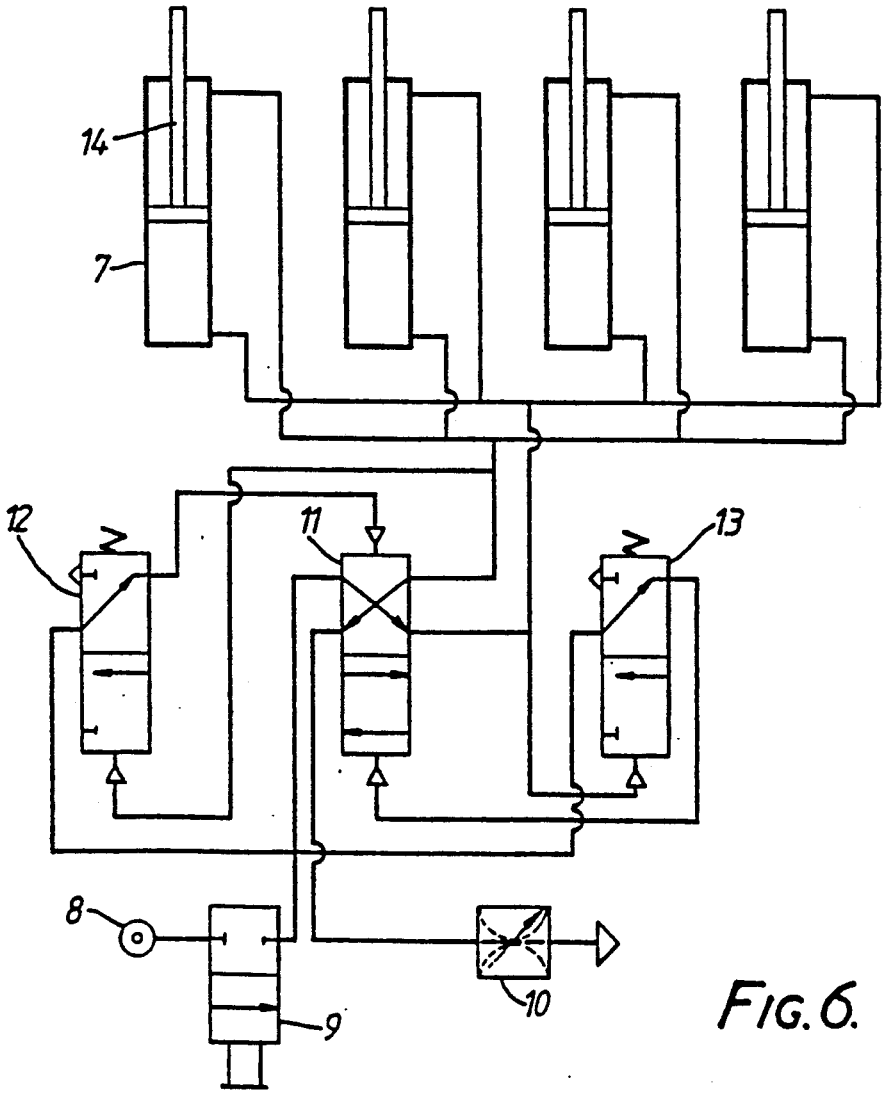
FIG. 6 is a diagrammatic illustration of a fluid logic circuit for controlling the device of FIGS. 3 to 5.
Figure 3:
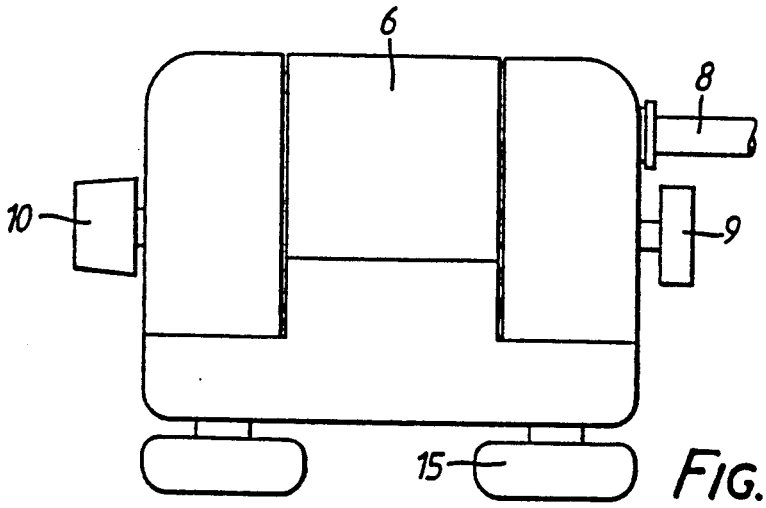
FIGS. 3, 4 and 5 are side, front and underneath plan views respectively of one form of physiotherapy device of this invention.
Figure 4:
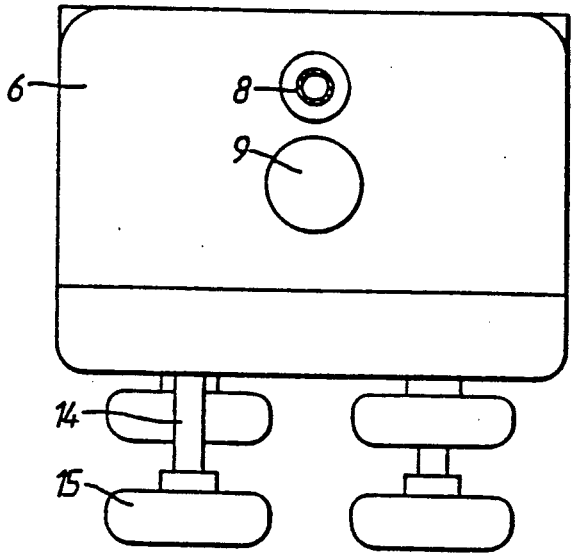
Figure 5:
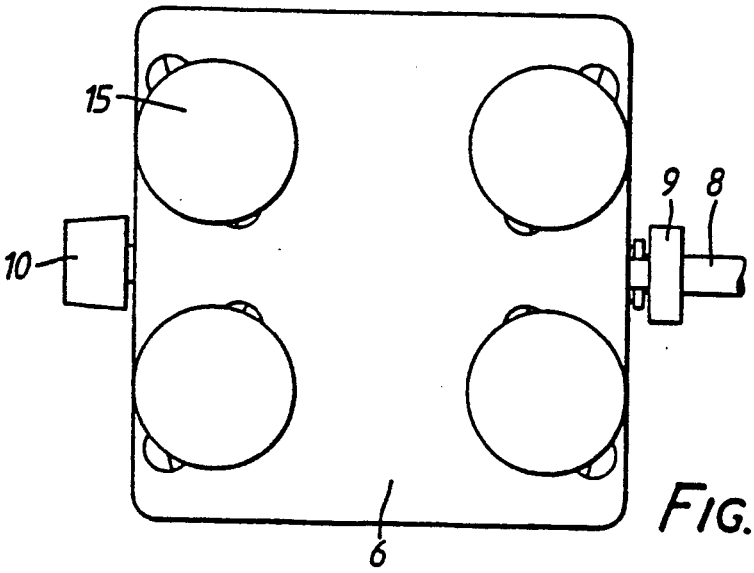

As shown in FIGS. 3 to 5 the tool comprises of a plastics housing 6 which incorporates four double acting cylinders 7, a supply fitting 8, an on/off pilot valve 9, a restrictor valve 10, and control valves 11, 12, 13 (see also FIG. 6). It is powered by compressed air, the regulation of which determines the force produced by the cylinders on pistons 14 leading to four feet 15. By depressing the pilot valve 9, compressed air is supplied to the three pneumatic logic valves 11 to 13. These control valves consist of a flip flop valve 11, and two NOT gates 12, 13. The flip flop valve 11 will change the polarity of flow when signalled to do so by a pilot signal from either NOT gate. The NOT gates 12 13 will give output signals to the flip flop valve only when they sense no pressure in their corresponding circuits.

The circuit is so designed that the pistons 14 of two cylinders 7 will be on a downward stroke while two will be on an upward stroke, each pair of diagonally opposed pistons being in sequence with one another. The circuit from the control valves to the cylinders can be visualized as being in two parts. Whilst one side is supplying, the other is exhausting and vice versa depending on the orientation of the flip flop valve 11. For simplicity we can call these side A and side B. As the compressed air is fed via the flip flop valve to side A of the cylinders the pistons force the air on side B of the cylinders to atmosphere through the restrictor valve 10.

The residual pressure caused by this operation in side B will be sensed by the NOT gates 12, 13 and once the circuit has been exhausted it will signal the flip flop to change polarity and hence the tool will cycle in the opposite direction. By increasing the restriction caused by the restrictor valve 10 it will take longer for the residual pressure to die away in the exhausting side of the circuit and so slow down the speed of oscillation.

In practice the feet 15 of the tool push against the patient's body until the resistance is equal to the force pre-set by the supply pressure. The pistons then cease to progress down the cylinders and this causes a rapid drop in pressure in the exhausting side of the circuit and in turn a change of cycle. In this manner the length of stroke is governed by the suppleness of the patient and the way in which the operator uses the tool. The device fits neatly into the palm of the hand and is easy to operate. The action of the device is tolerable, relaxing, even pleasant.

Figure 7:
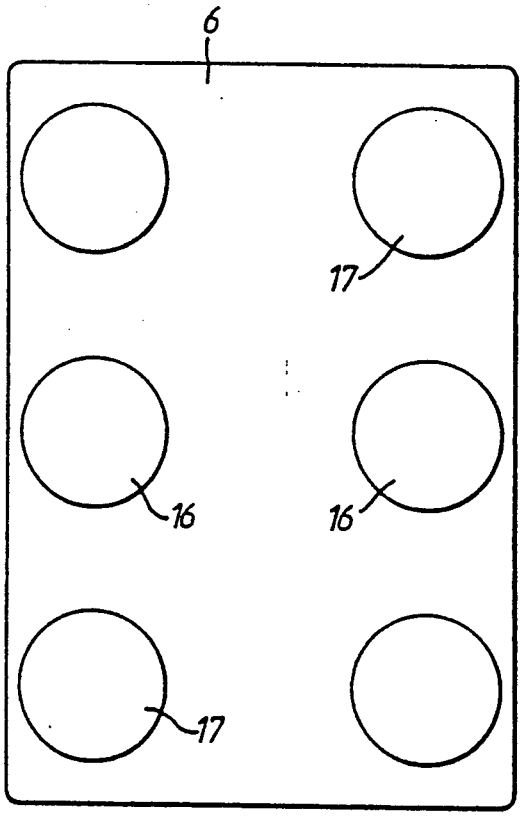
FIG. 7 is a representation of an alternative form of device of this invention in underneath plan view.

FIG. 7 illustrates a modified form of device to that shown in FIGS. 3 to 5. This has four fixed feet 17 at the corners of the body 6 and a pair of feet 16 which can be reciprocated. With this arrangement, rotational forces will be applied to one vertebra only by the moving feet 16, whilst the adjacent two vertebrae will be held against movement by the fixed feet 17.

Figure 8:
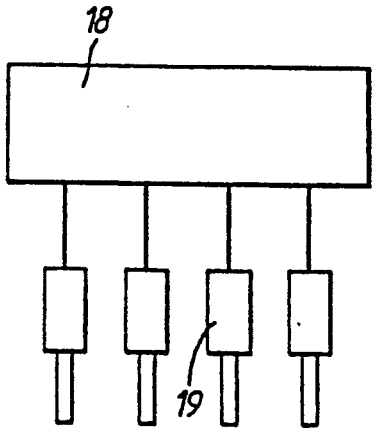
FIG. 8 is a diagrammatic representation of an electrical control unit for operating a physiotherapy device of this invention.

A wide range of variants may be produced, each with differing, even exaggerated characteristics. Some variants will be pneumatic, others may be electrically powered and employ electronic controls For example, FIG. 8 illustrates an electronic control circuit 18 which controls the required sequential operation of four solenoids 19 which act on the shafts 14 leading to the feet 15 illustrated in FIGS. 3 to 5.

Figure 9:
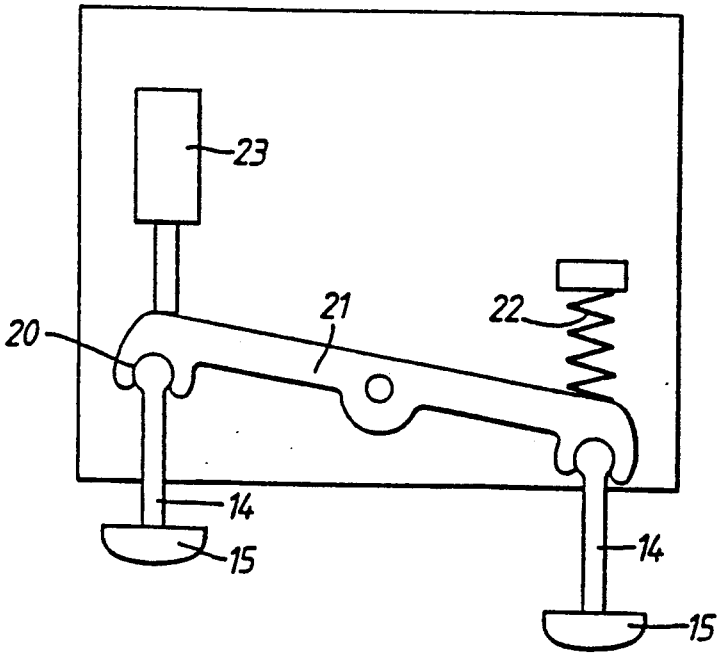
FIG. 9 is a diagrammatic sectional view through an alternative form of physiotherapy device of the invention.

Another form of construction is illustrated in FIG. 9, wherein a pair of feet 15 are connected to shafts 14 which are held in pivot arrangements 20 at the ends of a pivoted lever 21. A spring 22 biases one end of the lever 21 in a downward direction and a ram or solenoid actuator 23 can be operated against the bias of the spring 22 to reverse the attitudes of the two feet 15.

We claim:

1. A method of relieving mechanical disorders of the spine comprising the steps of:

A. providing a physiotherapy device comprising a body with reciprocatory actuators terminating in feet and projecting in the same direction but displaced at a distance equivalent to the spacing of the lateral ends of transverse processes to either side of a human vertebra, and means for reciprocating the actuators in mutually opposed directions;

B. locating the feet of the device over the lateral ends of the transverse processes of affected vertebrae;

C. operating the device to cause reciprocation of the actuators to deliver blows to the vertebrae to stimulate rotational displacement about the spinal axis of at least one vertebra with respect to the adjacent vertebrae; and D. moving the device along the spine to cause similar displacement to a sequence of vertebrae.

2. The method according to claim 1, wherein said reciprocatory actuators are four reciprocatory actuators forming two diagonal pairs of actuators housed within the body and terminating in feet which will rest on the two pairs of transverse processes on an adjacent pair of vertebrae, each diagonal pair of actuators acting synchronously but in mutually opposed direction to the other pair of actuators.

3. A physiotherapy device which includes:

A. a body of such size that it can be grasped manually by a physiotherapist and moved up and down the spine of a patient, B. two pairs of reciprocatory actuators housed within the body, C. said actuators terminating in feet which project in the same direction from the body, D. said actuators being located at the four corners of a rectangle wit the spacings between the actuators such that when, in use, the device is applied to the spine of a patient, the feet will rest on the two pairs of transverse processes on an adjacent pair of vertebrae, E. means for reciprocating the actuators, and F. a control circuit for controlling reciprocation of the actuators and including means whereby each diagonal pair of actuators will act synchronously but in mutually opposed directions to the other diagonal pair of actuators.

4. A physiotherapy device according to claim 3, wherein the reciprocatory actuators comprise pneumatic piston and cylinder mechanisms and the control circuit comprises pneumatic logic elements.

5. a physiotherapy device according to claim 4, wherein the control circuit includes a restrictor valve on the exhaust side of the pneumatic piston and cylinder mechanisms, said restrictor valve being so arranged that an increase in the restriction caused by the restrictor valve will reduce the speed of reciprocation of the piston and cylinder mechanisms.

6. A physiotherapy device according to claim 4, wherein the pneumatic logic elements comprise a flip-flop valve and a pair of NOT gates.

7. A physiotherapy device which includes:

A. a body housing two pairs of pneumatic piston and cylinder mechanisms, said body being of such size that it can be held manually by a physiotherapist and moved up and down the spine of a patient, B. the cylinders of said piston and cylinder mechanisms being arranged parallel to one another and located at the four corners of a rectangle, C. the pistons of said piston and cylinder mechanisms projecting in the same direction from the body and terminating in feet, D. said feet being positioned at such spacing that, when the device is moved, in use, by a physiotherapist into engagement with the spine of a patient, the feet will rest on the two pairs of transverse processes on an adjacent pair of vertebrae, E. means for connecting the body to a supply of compressed air for effecting controlled reciprocation of the pistons relative to the cylinders, and F. a control circuit for controlling reciprocation of the pistons relative to the cylinders, said control circuit including means whereby each diagonal pair of pistons will move synchronously but in mutually opposed direction to the other diagonal pair of actuators.

8. A physiotherapy device according to claim 7, wherein the control circuit includes a flip-flop valve, a pair of NOT gates and an adjustable restrictor valve for controlling the rate at which air can be exhausted from the cylinders.

* * * * *